US005240160A

United States Patent [19]

Okada et al.

[11] Patent Number: 5,240,160

[45] Date of Patent: Aug. 31, 1993

[54] ROTARY SPLITTING TOOL TO FABRICATE A FIBRILLATED WEB

[75] Inventors: Hirotsune Okada, Yachiyo; Tsutomu Matsuzaki, Ichihara; Kazuhiko Kurihara; Hiroshi Yazawa, both of Tokyo; Toshikazu Ohishi, Kawaguchi, all of Japan

[73] Assignees: Nippon Petrochemicals Company, Limited; Polymer Processing Research Inst., Ltd., both of Tokyo, Japan

[21] Appl. No.: 843,245

[22] Filed: Feb. 28, 1992

[30] Foreign Application Priority Data

Mar. 4, 1991 [JP] Japan ..... 3-62618

[51] Int. Cl.[5] ..... B26F 1/20; B26F 3/02

[52] U.S. Cl. ..... 225/97; 83/660; 264/DIG. 8

[58] Field of Search ..... 83/660, 867, 663; 225/3, 93, 97; 264/154, DIG. 8

[56] References Cited

U.S. PATENT DOCUMENTS

| | | | |
|---|---|---|---|
| 3,427,912 | 2/1969 | Nozawa et al. | 83/20 |
| 3,460,416 | 8/1969 | Gilbert | 225/3 X |
| 3,511,901 | 5/1970 | Brown | 225/3 X |
| 3,495,752 | 2/1970 | Kim et al. | 225/3 |
| 3,496,259 | 2/1970 | Guenther | 225/3 X |
| 3,550,826 | 12/1970 | Salmela | 225/97 X |
| 3,552,251 | 1/1971 | Neff et al. | 83/299 |
| 3,596,816 | 8/1971 | Brown | 225/3 X |
| 3,650,446 | 3/1972 | Samluk | 225/97 |
| 3,693,851 | 9/1972 | Yazawa | 225/3 |
| 4,637,286 | 1/1987 | Boggs | 225/97 X |

FOREIGN PATENT DOCUMENTS

| | | |
|---|---|---|
| 1957212 | 6/1970 | Fed. Rep. of Germany . |
| 46-39486 | 11/1971 | Japan . |
| 51-38979 | 9/1976 | Japan . |

*Primary Examiner*—Frank T. Yost
*Assistant Examiner*—Rinaldi Rada
*Attorney, Agent, or Firm*—Burns, Doane, Swecker & Mathis

[57] ABSTRACT

A rotary splitting tool for splitting a web of plastic material to fabricate a fibrillated web, comprising a rotatable body having a plurality of transverse ridges provided on the periphery in a circumferentially equidistant relationship and extending generally parallel to the central rotation axis, and rows of cutting edges provided on the transverse ridges, respectively. Convex walls are provided on the periphery of the body between the adjacent transverse ridges. The convex wall means receives a web to be split so that oscillation of the web during repeated operations of the cutting edges can be minimized to reduce noise and prevent irregular slits.

12 Claims, 5 Drawing Sheets

ROTARY SPLITTING TOOL TO FABRICATE A FIBRILLATED WEB

BACKGROUND OF THE INVENTION

1. Field of the Invention

The present invention relates to a rotary splitting tool for slitting a web, such as an uniaxially stretched tape or film to fabricate a fibrillated web having a network structure with generally longitudinally extending ribbons.

2. Description of the Related Art

A nonwoven fabric can be fabricated by laminating two layers of webs together. One of the webs may be a slit sheet having a network structure like a weft of a woven fabric and the other may be a slit sheet having a network structure like a warp of a woven fabric. The slit sheet is fabricated from a continuous nonporous plastic sheet material by splitting or slitting the latter using a rotary slitting tool that has a plurality of cutting edges on the periphery thereof.

Japanese Examined Patent Publication (Kokoku) No. 46-39486 and Japanese Examined Utility Model Publication (Kokoku) No. 51-38979 disclose a rotary splitting tool having cutting edges on the periphery thereof for the fabrication of a warp-type slit sheet. The web to be split is fed under tension and the rotary splitting tool is urged to the web and driven at a peripheral speed greater than the speed of the web. The cutting edges of the rotary splitting tool pierce and tear the web because of the difference in the speed so that slits are formed in the web.

Recently, a rotary splitting tool formed in a one-piece structure has been developed, as disclosed in Japanese Examined Utility Model Publication (Kokoku) No. 51-38979, which has a polygonal prismatic body with six ridges or corners and cutting edges are integrally formed on the ridges. That is, the cutting edges are machined at the ridges of the polygonal prismatic body. Since the cutting edges are integrally formed with the polygonal prismatic body, this rotary splitting tool meets the requirement such that the rotary splitting tool should be driven at a very high speed to provide a high manufacturing output. There are, of course, other types of rotary splitting tools having a cylindrical body to which separate cutting edges are arranged, but these types of rotary splitting tools are not adapted for high speed rotation since the cutting edges may be subjected to centrifugal force and are apt to separate from the body.

In the conventional rotary splitting tool of a one-piece structure, the polygonal prismatic body comprises ridges and flat surfaces between the ridges, with the cutting edges provided in the ridges. In operation, as the rotary splitting tool rotates, the cutting edges on one of the ridges engage with the web and disengage therefrom, and the cutting edges on the next ridges engage with the web and disengage therefrom, and such engaging-disengaging operations are repeated successively. Thus the web oscillates with a large amplitude and strikes the flat surfaces of the polygonal prismatic body, creating a relatively large noise. Also, the oscillation of the web causes slits being formed to expand in an uncontrolled manner or irregularly, resulting in the length of the slits being formed not uniform or a breakage in the resultant slit sheet. If the length of the slits is not uniform and a breakage exists in the slit sheet, the quality of the product deteriorates and the subsequent manufacturing step is affected.

SUMMARY OF THE INVENTION

The object of the present invention is to solve the above described problems and provide a rotary splitting tool by which noise and irregular propagation of the slits are prevented.

According to the present invention, there is provided a rotary splitting tool for slitting a web of plastic material to fabricate a fibrillated web, said rotary splitting tool being formed in a one-piece structure comprising a rotatable body having a central rotation axis, a periphery with opposite ends, a plurality of transverse ridges provided on the periphery in a circumferentially spaced relationship and extending generally from one end to the opposite end, rows of cutting edges provided on the transverse ridges, respectively, and a convex wall means on the periphery of the body between the adjacent transverse ridges for receiving a web thereat when the web is cut by at least one of the rows of the cutting edges.

With this arrangement, the convex wall means receives the web between the adjacent transverse ridges so that oscillation of the web during repeated operations of the cutting edges can be minimized. Accordingly, it is possible for the rotary splitting tool to perform a desired function.

BRIEF DESCRIPTION OF THE DRAWINGS

The present invention will become more apparent from the following description of the preferred embodiments, with reference to the accompanying drawings, in which.

Figure 1:
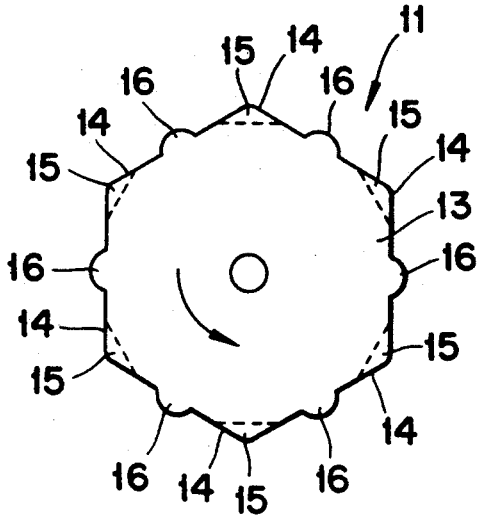
FIG. 1 is a side view of a rotary splitting tool according to the first embodiment of the present invention.
Figure 3:
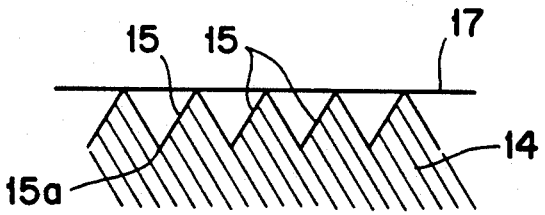
Figure 4:
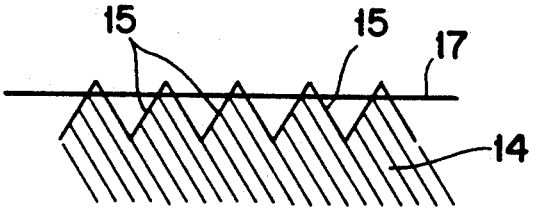
Figure 5:
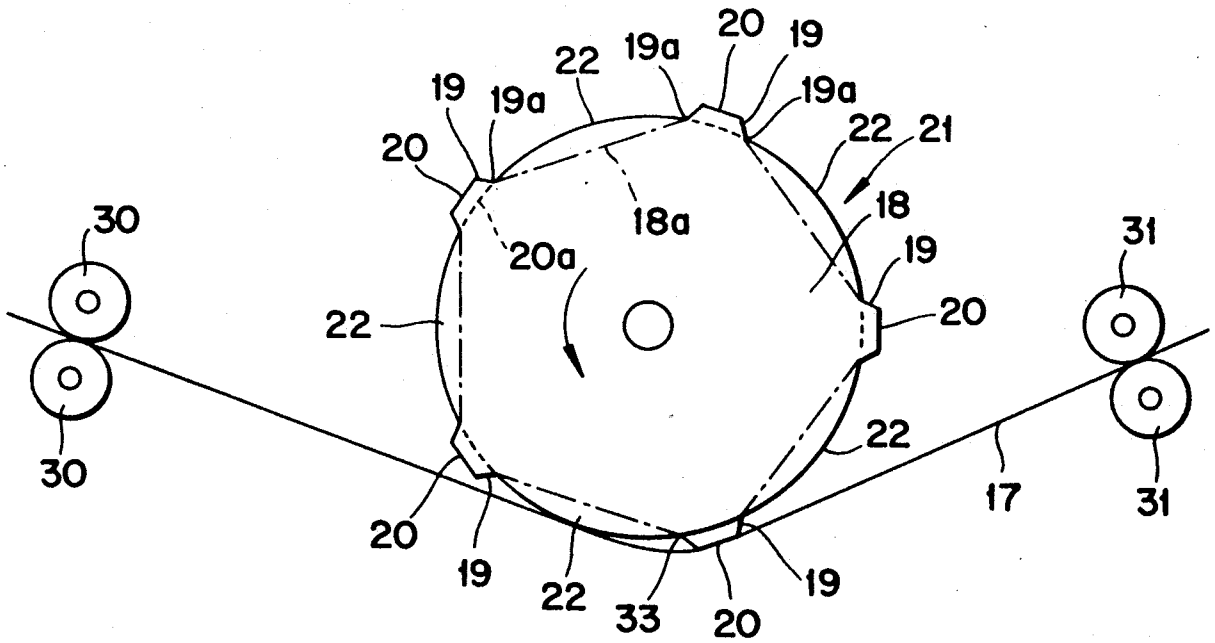
Figure 6:
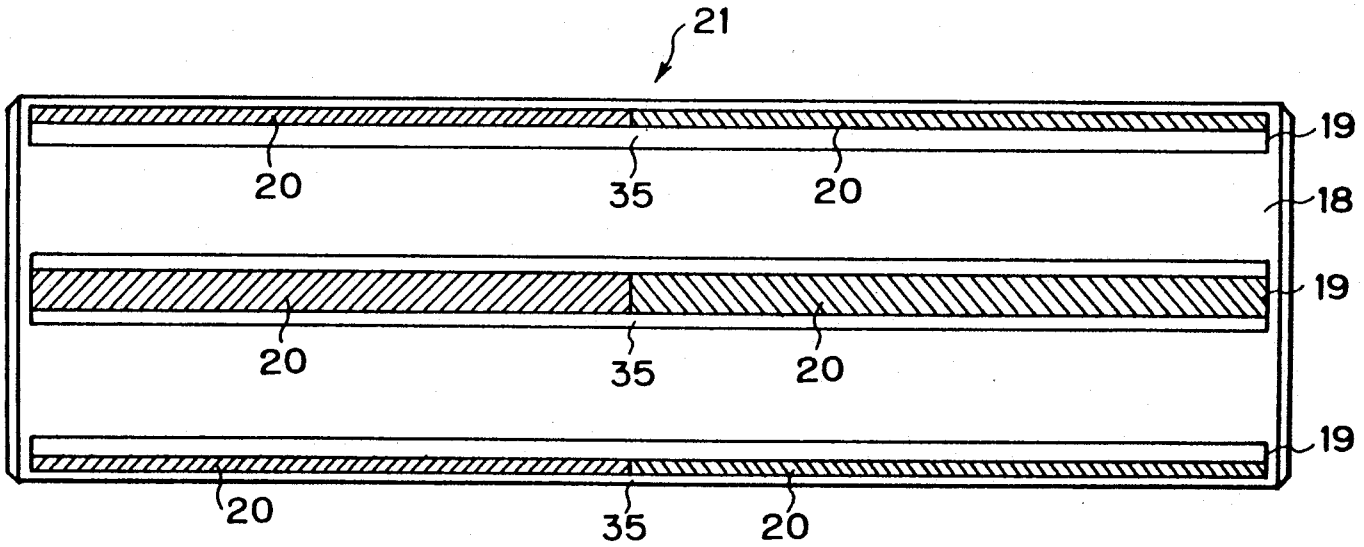
Figure 7:
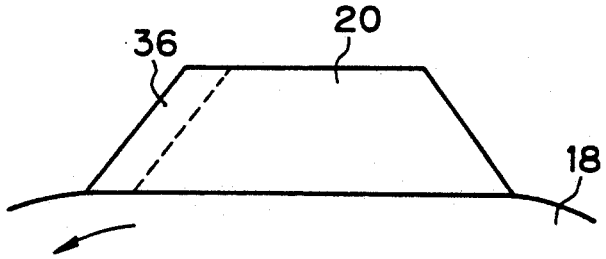
Figure 8:
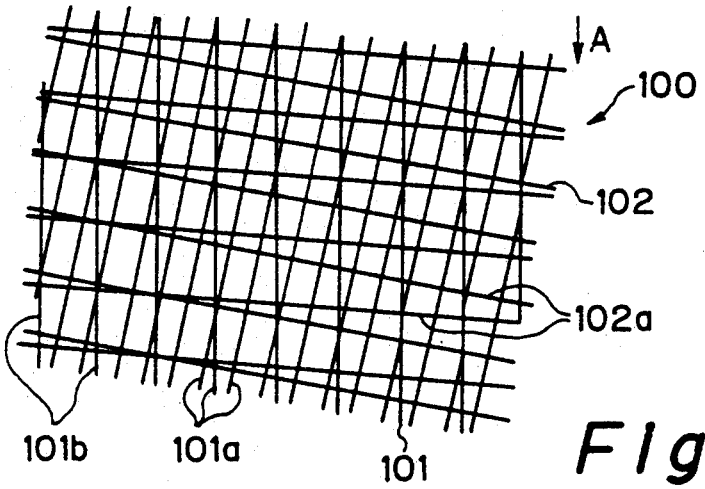

Fib. 3 is a partial view of the rotary splitting tool of FIG. 1;

FIG. 4 is a view similar to FIG. 3 but illustrating the cutting edges piercing the web;

FIG. 5 is a side view of a rotary splitting tool according to the second embodiment of the present invention;

FIG. 6 is a front view of the cutting edges of the rotary splitting tool of FIG. 5;

FIG. 7 is a front view of one of the cutting edges;

FIG. 8 is a view of a nonwoven fabric; and

Figure 9:
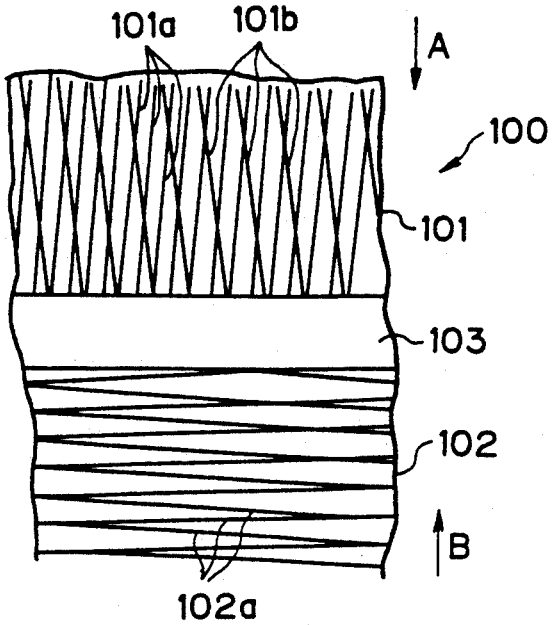

FIG. 9 is a view of a laminating process of the nonwoven fabric of FIG. 8.

DESCRIPTION OF THE PREFERRED EMBODIMENTS

A rotary splitting tool according to the present invention can be used, for example, in fabricating a nonwoven fabric 100, shown in FIG. 8. In FIG. 8, the nonwoven fabric 100 comprises a lamination of two layers of webs 101 and 102. An arrow A shows the longitudinal direction of the webs 101 and 102 The first web 101 has a network structure having generally longitudinally (slightly oblique) extending ribbons 101*a* and narrow connecting ribbons 101*b* as in a warp of a woven fabric. The second web 102 has a network structure having generally laterally extending ribbons 102*a* as in a weft of a woven fabric. The nonwoven fabric 100 can be fabricated through a laminating process using a laminator 103, as shown in FIG. 9. In this example, the first web 101 is fed to the laminator 103 in the direction of the arrow A, and the second web 102 is fed to the laminator 103 in the direction of the arrow B.

The first web 101 of FIGS. 8 and 9 is fabricated from a continuous nonporous plastic sheet material by three steps, for example. The nonporous plastic sheet material is longitudinally stretched, split to form longitudinal slits using a rotary splitting tool according to the present invention, and then laterally spread. It will be apparent that the longitudinally (slightly oblique) extending ribbons 101*a* and narrow connecting ribbons 101*b* are the portions of the material sheet enclosing the slits. The second web 102 can also be fabricated from a continuous nonporous plastic sheet material by the steps of laterally slitting the plastic sheet material and laterally stretching the slit sheet. It will be apparent that the ribbons 101*a* and 101*b* of the first web 101 are distributed with a density greater than that of the ribbons 102*a* of the second web 102. Thus, the rotary splitting tool for the first web 101 must have more cutting edges than those for the second web 102.

Figure 2:
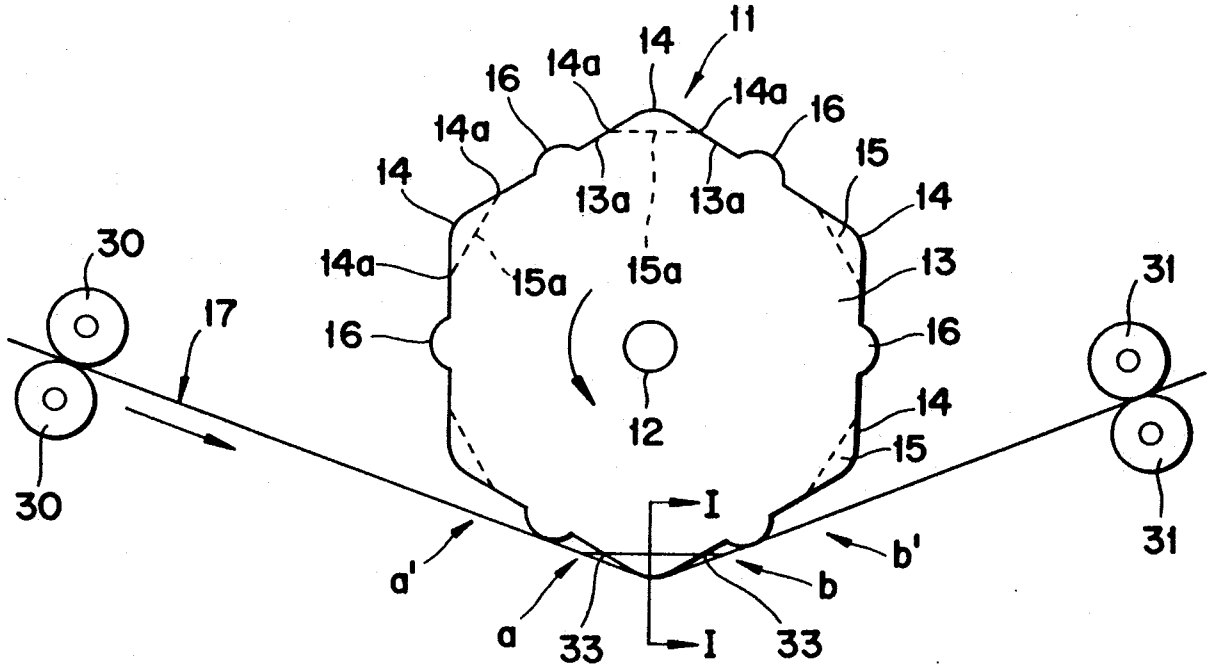
FIG. 2 is a view of the rotary splitting tool of FIG. 1 engaged with a web to be slit.

FIGS. 1 and 2 show a rotary splitting tool 11 according to the first embodiment of the present invention. The rotary splitting tool 11 is formed in a one-piece structure comprising a rotatable hexagonal prismatic body 13 mounted on a central support shaft 12, and six transverse ridges 14 provided on the periphery in a circumferentially equidistant relationship and extending generally parallel to the central, support, shaft 12. A plurality of cutting edges 15 are provided on each of the transverse ridges 14, respectively. These cutting edges 15 are cut in each of the transverse ridges 14 so as to extend generally perpendicular to the central support shaft 12 and lie obliquely to the end face of the body 13, as shown in FIG. 6. The cutting edges 15 have peaks and valleys 15*a* between the adjacent peaks, as may be seen in FIG. 3, which is a cross-sectional view of the cutting edges of a transverse ridge 14.

The rotary slitting tool 11 also comprises convex walls 16 on the periphery of the hexagonal prismatic body 13 between the adjacent transverse ridges 14 for receiving a web 17 thereat when the web 17 is cut by at least one of the rows of the cutting edges 15. In the embodiment of FIGS. 1 and 2, the cutting edges 15 has a triangular shape. As shown in FIG. 2, a root 14*a* is defined by the point where each of the ridges 14 forms a merging point of the valleys 15*a* between cutting edges 15 with the periphery of the body 13, and thus defines a minimum reference contour of the body. A part of the surface of the body 13 lies on a straight line 13*a* that connects the roots 14*a* on adjacent ridges 14.

As shown in FIG. 2, the web 17 is longitudinally stretched at a preceding step about 8 times as long as the original film and fed to the splitting station where the web 17 is guided by two pairs of pinch rollers 30 and 31 under tension. In the embodiment, the speed of the pinch rollers 31 on the downstream side is slightly faster than the speed of the pinch rollers 30 on the upstream side. The rotary splitting tool 11 is urged to the web 17 so that the web 17 is angled and a desired portion of the web 17 contacts the rotary splitting tool 11. The rotary splitting tool 11 is driven in the same direction as the travelling direction of the web 17 at a peripheral speed higher than the speed of the web 17, in the range of from two to five times the speed of the web 17.

As the rotary splitting tool 11 rotates, the cutting edges 15 located at the respective ridges 14 repeatedly engage with and disengage from the web 17 one after another to slit the web 17. Namely, the cutting edges 15 on one of the ridges 14 engage with the web 17 and disengage therefrom, and prior to or after the disengagement of those cutting edges 15, according to the disposition of the slits to be formed in the web 17 and the design of the rotary slitting tool 11, the cutting edges 15 on the next ridge 14 engage with the web 17.

FIG. 3 shows the cutting edges 15 on one of the ridges 14 are brought into contact with the web 17. As shown in FIG. 4, the cutting edges 15 then pierce and tear the web 17 to form slits in the web 17. As shown in FIG. 2, the thus formed slits 33 longitudinally expand from the portion of the web 17 contacting the cutting edges 15 to the region between the points a and b shown in FIG. 2. The slits 33 further grow at once to the region between the points a, and b, shown in FIG. 2, to an extent depending on the angle of the web 17 contacting the rotary splitting tool 11 and the tension of the web 17. It can be said that the sharper the contacting angle of the web 17 and the greater the tension of the web 17, the greater the length of the slits 33.

The convex wall 16 located between the adjacent rows of the cutting edges 15 receives the web 17 until the following row of the cutting edges 15 are brought into contact with the web 17 after the preceding row of the cutting edges 15 are engaged with the web 17. The web 17 continuously contacts the convex wall 16 during the transfer of the contact to the web 17 from the preceding row of the cutting edges 15 to the following row of the cutting edges 15, and thus the oscillation of the web 17 caused by the successive engagement of the cutting edges 15 to the web 17 is minimized. Accordingly, it is possible to minimize noise and prevent uncontrolled or irregular expansion of the slits 33.

FIG. 5 shows a rotary splitting tool 21 according to the second embodiment of the present invention. The rotary splitting tool 21 is formed in a one-piece structure comprising a rotatable pentagonal prismatic body 18, five transverse ridges 19 provided on the periphery in a circumferentially equidistant relationship, cutting edges 20 provided on the transverse ridges 14, and convex walls 22 on the periphery of the pentagonal prismatic body 18 between the adjacent transverse ridges 19 for receiving a web 17 thereat. The operation of this embodiment is similar to that of the embodiment of FIG. 1 and 2.

As shown in FIG. 5, a root 19*a* is defined by the point where each of the ridges 19 forms a merging point of the valleys 20*a* between cutting edges 20 with the periphery of the body 18. A straight line 18*a* connects the roots 19*a* between adjacent ridges 19. In this embodiment, the convex walls 22 has an arcuate shape extending on, that is, described by a common circle having a radius between the central rotation axis and the route 19*a*.

As shown in FIG. 6, the cutting edges 20 are cut in the transverse ridges 19 like screw threads; i.e., the cutting edges 20 are arranged oblique to the ridges 19. Preferably, each of the ridges 19 has a midpoint 35, and the cutting edges 20 on the lefthand half portion of the ridge 19 from the midpoint 35 are arranged oblique to the ridges in one sense that is, orientation to the ridges and the cutting edges 20 on the righthand half portion of the ridge 19 from the midpoint 35 are arranged oblique to the ridges 19 in an opposite sense or orientation.

As shown in FIGS. 5 and 7, each of the cutting edges 20 has a trapezoidal shape. Accordingly, when a leading end portion 36 of the cutting edge 20, viewed from the rotational direction of the rotary splitting tool 21 as represented by the arrow, is dull, it is possible to sharpen the leading end portion 36 as shown by the broken line to restore the said cutting edges 20.

The convex walls 16 or 22 can have any desired shape but preferably include a smoothly curved surface. The convex walls 16 or 22 can extend continuously axially of the body 13 or 18 between the opposite ends thereof, but it is possible that the convex walls 16 or 22 extends discontinuously axially of the body 13 or 18. The convex walls 16 or 22 can be made separate from the body 13 or 18 and firmly attached to the body 13 or 18. However, preferably the convex walls 16 or 22 are made by machining the periphery of body 13 or 18.

As the rotary splitting tool 11 rotates, the cutting edges 15 located at the respective ridges 14 repeatedly engage with and disengage from the web 17 one after another to slit the web 17. Namely, the cutting edges 15 on one of the ridges 14 engage with the web 17 and disengage therefrom, and prior to or after the disengagement of those cutting edges 15 according to the disposition of the slits to be formed in the web 17 and the design of the rotary slitting tool 11, the cutting edges 15 on the next ridge 14 engage with the web 17.

As explained, according to the present invention, a convex wall means receives a web between adjacent transverse ridges so that oscillation of the web during repeated operations of the cutting edges can be minimized, and accordingly, noise is reduced and the formation of irregular slits are prevented.

We claim:

1. A rotary splitting tool for splitting a web of plastic material to fabricate a fibrillated web, said rotary splitting tool comprising:

a rotatable body having a central rotation axis;

a periphery with opposite ends;

a plurality of transverse ridges provided on the periphery in a circumferentially spaced relationship and extending generally from one end to the opposite end, a row of cutting edges provided on each of the transverse ridges; and, convex wall means on the periphery of the body between adjacent transverse ridges for receiving a web thereat when the web is cut by at least one of the rows of the cutting edges.

2. A rotary splitting tool according to claim 1, wherein each of said ridges has a root that is a merging point of valleys between adjacent cutting edges with the periphery, and said convex wall means protrudes beyond a straight line connecting the roots of the adjacent ridges.

3. A rotary splitting tool according to claim 1, wherein each of said ridges has a root that is a merging point of valleys between adjacent cutting edges with the periphery, and said convex wall means has an arcuate shape extending on a common circle having a radius between the central rotation axis and the root.

4. A rotary splitting tool according to claim 1, wherein the transverse ridges are provided on the periphery of the rotatable body in a circumferentially equidistant relationship and extending generally parallel to the central axis.

5. A rotary splitting tool according to claim 1, further comprising a means for guiding the web under tension so that the web contacts at least one ridge and one convex wall.

6. A rotary splitting tool according to claim 1, wherein the rotatable body is formed in a one-piece structure.

7. The rotary splitting tool according to claim 1, further comprising means for conveying a web of material in a conveying direction under tension so that at least one of the rows of cutting edges contacts the web to fabricate a fibrillated web having slits extending generally parallel to the conveying direction.

8. The rotary splitting tool according to claim 1, wherein a plurality of cutting edges are arranged in parallel in a row on each transverse ridge.

9. The rotary splitting tool according to claim 1, wherein, the cutting edges of each row rise from the body perpendicular to the central axis of the body and have valleys between cutting edges.

10. A rotary splitting tool for splitting a web of plastic material to fabricate a fibrillated web, said rotary splitting tool being formed in a one-piece structure comprising:

a rotatable body having a central rotation axis;

a periphery with opposite ends;

a plurality of transverse ridges provided on the periphery in a circumferentially spaced relationship and extending generally from one end to the opposite end;

rows of cutting edges provided on the transverse ridges and arranged oblique to the ridges, respectively; and, convex wall means on the periphery of the body between the adjacent transverse ridges for receiving a web thereat when the web is cut by at least one of the rows of the cutting edges.

11. A rotary splitting tool according to claim 10, wherein each of the ridges has a midpoint, opposite ends, a first portion between the midpoint and one of the opposite ends, and a second portion between the midpoint and the other end, and said cutting edges of said first portion are arranged oblique to the ridges in one sense and said cutting edges of said second portion are arranged oblique to the ridges in an opposite sense.

12. A rotary splitting tool for splitting a web of plastic material to fabricate a fibrillated web, said rotary splitting tool being formed in a one-piece structure comprising:

a rotatable body having a central rotation axis;

a periphery with opposite ends;

a plurality of transverse ridges provided on the periphery in a circumferentially spaced relationship and extending generally from one end to the opposite end;

rows of cutting edges formed with trapezoidal shape provided on the transverse ridges, respectively; and, convex wall means on the periphery of the body between the adjacent transverse ridges for receiving a web thereat when the web is cut by at least one of the rows of the cutting edges.

* * * * *